US010605261B2

(12) United States Patent
Takeuchi et al.

(10) Patent No.: US 10,605,261 B2
(45) Date of Patent: Mar. 31, 2020

(54) AIR-BLOWING DEVICE

(71) Applicant: DENSO CORPORATION, Kariya, Aichi-pref. (JP)

(72) Inventors: Kazuhiro Takeuchi, Kariya (JP); Hiroshi Chakida, Kariya (JP); Isao Kondoh, Kariya (JP); Tsutomu Tanihira, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 600 days.

(21) Appl. No.: 15/032,256

(22) PCT Filed: Oct. 10, 2014

(86) PCT No.: PCT/JP2014/005171
§ 371 (c)(1),
(2) Date: Apr. 26, 2016

(87) PCT Pub. No.: WO2015/064023
PCT Pub. Date: May 7, 2015

(65) Prior Publication Data

US 2016/0245301 A1 Aug. 25, 2016

(30) Foreign Application Priority Data

Oct. 29, 2013 (JP) ..... 2013-224402

(51) Int. Cl.
*F04D 29/52* (2006.01)
*F04D 29/32* (2006.01)
(Continued)

(52) U.S. Cl.
CPC ..... *F04D 29/325* (2013.01); *F01P 1/06* (2013.01); *F01P 5/02* (2013.01); *F01P 5/06* (2013.01);
(Continued)

(58) Field of Classification Search
CPC .... F04D 29/541; F04D 29/547; F04D 29/663; F04D 29/545; F04D 29/325; F04D 29/526; F01P 5/06; F01P 5/08
See application file for complete search history.

(56) References Cited

U.S. PATENT DOCUMENTS

2008/0195983 A1 8/2008 Chidambarrao et al.
2009/0119982 A1 5/2009 Gallo et al.
(Continued)

FOREIGN PATENT DOCUMENTS

EP 1624196 A2 2/2006
JP H06042498 A 2/1994
(Continued)

OTHER PUBLICATIONS

International Search Report and Written Opinion (in Japanese with English Translation) for PCT/JP2014/005171, dated Jan. 6, 2015; ISA/JP.

*Primary Examiner* — Ninh H. Nguyen
*Assistant Examiner* — Behnoush Haghighian
(74) *Attorney, Agent, or Firm* — Harness, Dickey & Pierce, P.L.C.

(57) ABSTRACT

An air-blowing device has a blower fan that is an axial fan located on a downstream side of a heat exchanger in an airflow direction and supplies air to the heat exchanger and a shroud that supports the blower fan and forms an air passage extending from the heat exchanger to the blower fan. At least one side of a periphery of the heat exchanger is arranged to overlap with an outermost peripheral portion of the blower fan that is outermost in a radial direction of the blower fan when viewed in the airflow direction. The shroud has an air-introduction part that is (i) disposed, in a portion in which the ring part and the connection part connect to each other, on a surface of the connection part facing the heat exchanger and (ii) formed concentrically to be centered
(Continued)

at a rotational axis of the blower fan. A part of the air-introduction part protrudes outwardly from a periphery of the connection part in the radial direction of the blower fan when viewed in the airflow direction. A protruding part is provided in the connection part on a boundary between the air-introduction part and a portion other than the air-introduction part.

10 Claims, 4 Drawing Sheets

(51) Int. Cl.

| | |
|---|---|
| ***F04D 19/00*** | (2006.01) |
| ***F04D 29/54*** | (2006.01) |
| ***F04D 29/68*** | (2006.01) |
| ***F04D 29/66*** | (2006.01) |
| ***F01P 5/06*** | (2006.01) |
| ***F01P 1/06*** | (2006.01) |
| ***F01P 5/02*** | (2006.01) |
| ***F04D 29/58*** | (2006.01) |
| *F01P 5/08* | (2006.01) |

(52) U.S. Cl.
CPC ..... *F04D 19/002* (2013.01); *F04D 29/526* (2013.01); *F04D 29/545* (2013.01); *F04D 29/584* (2013.01); *F04D 29/663* (2013.01); *F04D 29/667* (2013.01); *F04D 29/681* (2013.01); *F01P 5/08* (2013.01); *F04D 29/326* (2013.01); *F04D 29/541* (2013.01); *F04D 29/547* (2013.01); *F05D 2250/182* (2013.01); *F05D 2250/183* (2013.01)

(56) References Cited

U.S. PATENT DOCUMENTS

| | | | |
|---|---|---|---|
| 2010/0212222 | A1 | 8/2010 | Gallo |
| 2012/0301329 | A1 | 11/2012 | Bilodeau et al. |

FOREIGN PATENT DOCUMENTS

| | | | |
|---|---|---|---|
| JP | 2001165094 | A | 6/2001 |
| JP | 2005156040 | A | 6/2005 |
| JP | 2006046113 | A | 2/2006 |
| JP | 2008106802 | A | 5/2008 |
| JP | 4191431 | B2 | 12/2008 |
| WO | WO-2009062291 | A1 | 5/2009 |
| WO | WO-2012162650 | A1 | 11/2012 |

AIR-BLOWING DEVICE

CROSS REFERENCE TO RELATED APPLICATIONS

This application is a U.S. National Phase Application under 35 U.S.C. 371 of International Application No. PCT/JP2014/005171 filed on Oct. 10, 2014 and published in Japanese as WO 2015/064023 A1 on May 7, 2015. This application is based on and claims the benefit of priority from Japanese Patent Application No. 2013-224402 filed on Oct. 29, 2013. The entire disclosures of all of the above applications are incorporated herein by reference.

TECHNICAL FIELD

The present disclosure relates to an air-blowing device blowing air to a heat exchanger such as a radiator.

BACKGROUND ART

Conventionally, an air-blowing device is known to have an axial fan supplying air to a radiator and a shroud that supports the axial fan and forms an air passage extending from the radiator to the axial fan.

Generally, in this kind of air-blowing device, the shroud has a rectangular shape in a plane view to fit the radiator having a rectangular shape. Accordingly, a length (that will be referred to as a length of an air-introduction part) between an outer end portion of the axial fan in a radial direction and a periphery of the shroud becomes partially short or partially long. In a part where the length of the air-introduction part is long, an attack angle decreases since an air volume flowing into the axial fan increases. On the other hand, in a part where the length of the air-introduction part is short, the attack angle increases since the air volume flowing into the axial fan decreases.

Therefore, a negative pressure caused on a surface of a blade of the axial fan varies between in the part where the length of the air-introduction part is long and in the part where the length of the air-introduction part is short, and changes alternately. This variation of the pressure waves air and transmits as a sound wave. According to the above-described shroud having a rectangular shape in a plane view, an order sound-component that is synchronized with a rotation of the axial direction increases, and a noise may increase, since the sound wave has a periodicity.

On the other hand, in an air-blowing device described in Patent Literature 1, by providing an opening in an air passage of a shroud on an upstream side of an axial fan, an unbalance of pressure is canceled and a first-order and second-order rotational noises are reduced. Furthermore, in the air-blowing device, by providing a current plate that protrudes inward from an inner surface of the shroud located on an upstream side of the axial fan, a second-order and fourth-order rotational noises are also reduced.

PRIOR ART LITERATURES

Patent Literature

Patent Literature 1: JP H06-42498 A

SUMMARY OF INVENTION

However, it is necessary to take a delicate pressure balancing with the air-blowing device described in the above-mentioned Patent Literature 1. Accordingly, when mounted in a vehicle, a pressure balancing changes by a pressure variation that is caused on a vehicle side, and a sufficient noise reduction effect may not be acquired.

For reducing the noise, a technique that a shroud is formed in a ring shape fitting a blower fan such that the length of the air-induction part of the shroud becomes uniform along all circumferences may be considered. However, when the shroud is formed in the ring shape, it may be difficult to introduce air that flows out of the radiator having the rectangular shape in the plane view to the blower fan. As a result, a cooling performance (i.e., a heat-exchanging performance) of the radiator may deteriorate.

The present disclosure addresses the above issues, and it is an objective to provide an air-blowing device with which a noise can be reduced certainly while securing a heat-exchanging performance of a heat exchanger.

To achieve the above objective, an air-blowing device of the present disclosure has a blower fan and a shroud. The blower fan is an axial fan located on a downstream side of a heat exchanger in an airflow direction and supplies air to the heat exchanger. The shroud supports the blower fan and forms an air passage extending from the heat exchanger to the blower fan. The heat exchanger has a rectangular outline when viewed in the airflow direction. At least one side of a periphery of the heat exchanger is arranged to overlap with an outermost peripheral portion of the blower fan that is outermost in a radial direction of the blower fan when viewed in the airflow direction. The shroud is formed in an annular shape, and the blower fan is rotatably disposed on an inner side of the annular shape. The shroud has a ring part, a connection part, and an air-introduction part. The ring part covers an outer periphery of the blower fan. The connection part connects a space on the downstream side of the heat exchanger to the ring part by a seamless passage. The air-introduction part is (i) disposed, in a portion in which the ring part and the connection part connect to each other, on a surface of the connection part facing the heat exchanger and (ii) formed concentrically to be centered at a rotational axis of the blower fan. A part of the air-introduction part protrudes outwardly from a periphery of the connection part in the radial direction of the blower fan when viewed in the airflow direction. A protruding part is provided in the connection part on a boundary between the air-introduction part and a portion other than the air-introduction part.

Since the air-introduction part is (i) disposed, in the portion in which the ring part and the connection part connect to each other, on the surface of the connection part facing the heat exchanger and (ii) formed concentrically to be centered at the rotational axis of the blower fan, a length of the air-introduction part in the radial direction of the blower fan becomes uniform along all circumferences. Accordingly, a length of the air-introduction part introducing air to the blower fan can be uniform along all circumferences. Therefore, no pressure variation on a surface of a blade of the blower fan is caused, and a noise can be reduced certainly.

In this case, by forming the heat exchanger in the rectangular outline when viewed in the airflow direction, and by arranging at least one side of the periphery of the heat exchanger to overlap with the outermost peripheral portion of the blower fan that is outermost in the radial direction of the blower fan when viewed in the airflow direction, air can be supplied to the periphery at the at least one side of the periphery of the heat exchanger. Therefore, a heat-exchanging performance of the heat exchanger can be improved.

Thus, the noise can be reduced certainly while securing the heat-exchanging performance of the heat exchanger.

A term "arranging to overlap" described in the present disclosure does not mean only a condition of being arranged to overlap entirely, and a condition of being slightly misaligned by a manufacturing error or an assembly error is in a range of the term "arranging to overlap".

DESCRIPTION OF EMBODIMENTS

Embodiments of the present disclosure will be described hereafter referring to drawings. In the embodiments, a part that corresponds to or equivalents to a matter described in a preceding embodiment may be assigned with the same reference number.

First Embodiment

Figure 1:
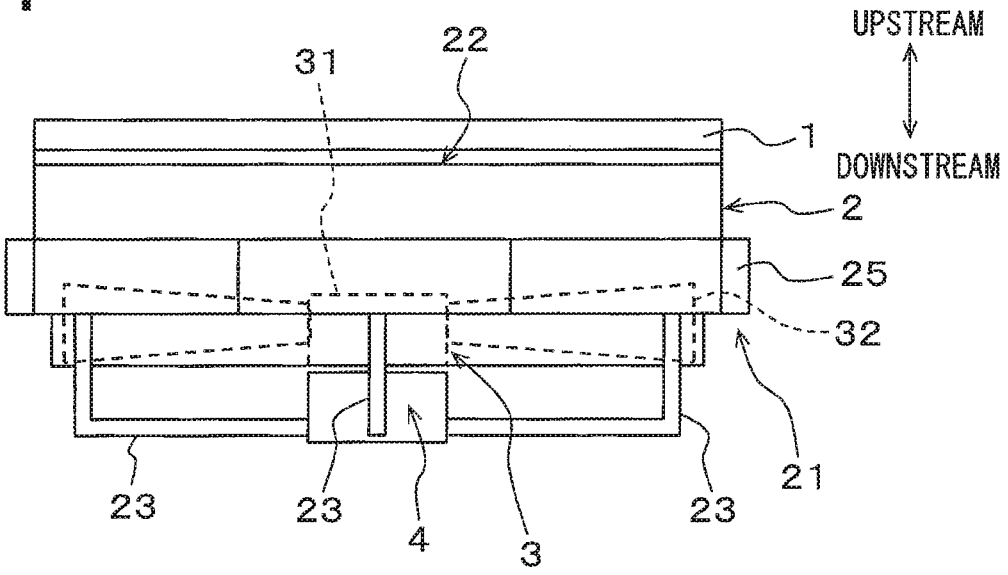
FIG. 1 is a view illustrating a sectional configuration of an air-blowing device according to a first embodiment.

A first embodiment of the present disclosure will be described hereafter referring to FIGS. 1 to 5. As shown in FIG. 1, an air-blowing device of the present embodiment is used for a cooling of a radiator 1 of a vehicle. The air-blowing device is configured to have a shroud 2, an axial fan 3, and a motor 4.

The radiator 1 is a heat exchanger that cools an engine coolant by causing a heat exchange between the engine coolant and an outside air. An outline of the radiator 1 has a rectangular shape (i.e., generally a square shape in the present embodiment) in a plane view, in other words, when viewed in an airflow direction.

The shroud 2 is made of resin (e.g., fiberglass-containing polypropylene), supports the motor 4, and guides an airflow caused by the axial fan 3 to flow to the radiator 1. The shroud 2 is located on a rear side of the radiator in the vehicle, in other words, on a downstream side of the radiator 1 in the airflow direction.

The shroud 2 is formed in an annular shape (i.e., a tubular shape). The shroud 2 has a ring part 21 and a connection part 22. The ring part 21 is configured to cover an outer periphery of the axial fan 3. The connection part 22 connects a space on the downstream side of the radiator 1 to the ring part 21 by a seamless passage. A detail structure of the shroud 2 will be described later.

The axial fan 3 is an axial blower fan blowing air and rotates around a rotation axis. The axial fan 3 has blades 32 that extend radially from a boss part 31 provided at a rotational center and are arranged to be distanced from each other in a rotational direction. The axial fan 3 is arranged rotatably on an inner side of the ring part 21 of the shroud 2.

According to the present embodiment, a diameter of the axial fan 3 is equal to a length of each side of a periphery of the radiator 1 that has generally a square shape in the plane view. Accordingly, the each side of the periphery of the radiator 1 is arranged to overlap with an outermost peripheral portion of the axial fan 3 in a radial direction when viewed in the airflow direction. In the present embodiment, a term "arranging to overlap" described in the present disclosure does not mean only a condition of being arranged to overlap entirely, and a condition of being slightly misaligned by a manufacturing error or an assembly error is in a range of the term "arranging to overlap".

The motor 4 is an electric motor supplying a rotational force to the axial fan 3 and has a motor shaft (not shown). The motor 4 is supported by a motor stays 23 provided with the ring part 21. The motor 4 rotates the axial fan 3 by rotating the motor shaft (not shown) and causes air to flow in an axial direction of the axial fan 3, in other words, in an axial direction of the rotational axis.

A detail structure of the shroud 2 will be described.

Figure 2:
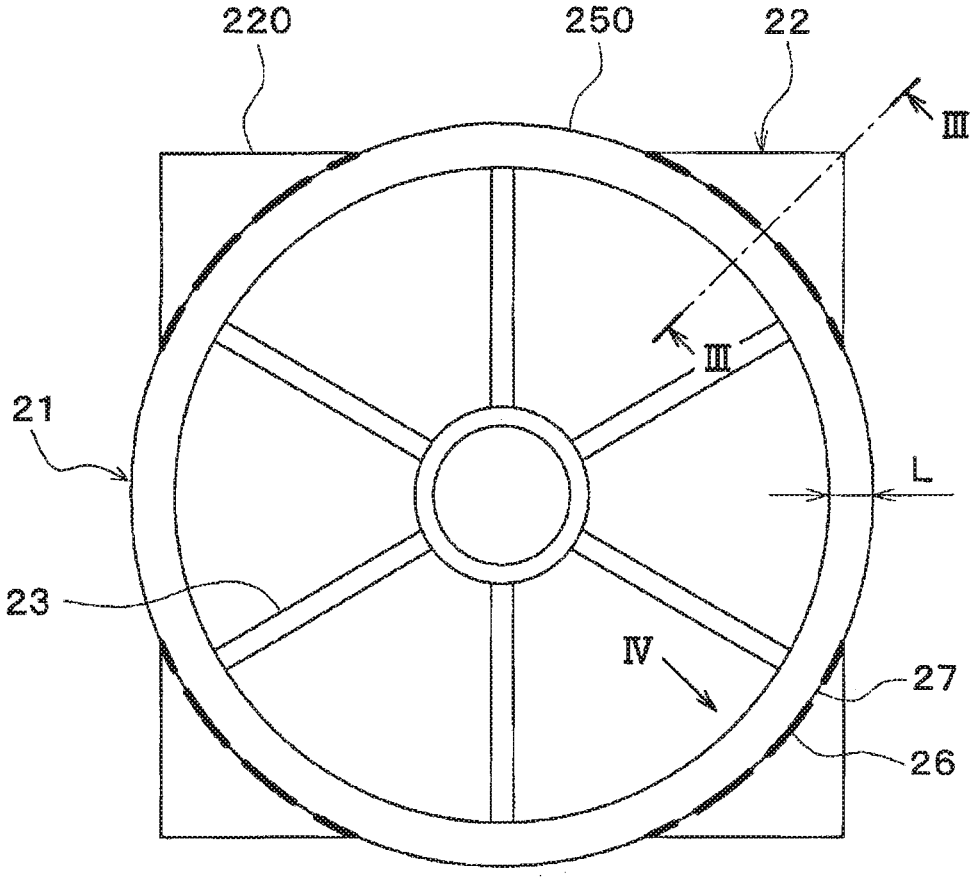
FIG. 2 is a plane view illustrating a shroud according to the first embodiment.

As shown in FIG. 2, the connection part 22 of the shroud 2 has substantially the same shape as the radiator 1 in the plane view, in other words, when viewed in the airflow direction. That is, according to the present embodiment, the connection part 22 has generally a square shape (i.e., a rectangular shape) in the plane view.

The shroud 2 has an air-introduction part 24 that is formed concentrically to be centered at the rotational axis of the axial fan 3. The air-introduction part 24 is disposed, in a portion in which the ring part 21 and the connection part 22 connect to each other, on a surface of the connection part 22 facing the radiator 1. The air-introduction part 24 has a length L in the radial direction of the axial fan 3 that is fixed along all circumferences.

A part of the air-introduction part 24 protrudes outwardly from a periphery 220 of the connection part 22 in the radial direction of the axial fan 3 when viewed in the airflow direction. That is, the air-introduction part 24 has a protruding part 25 that protrudes outwardly from the periphery 220 of the connection part 22 in the radial direction of the axial fan 3 when viewed in the airflow direction. In the present embodiment, the protruding part 25 is provided in each side of the periphery 220 of the connection part 22 that is formed in the square shape in the plane view.

Figure 3:
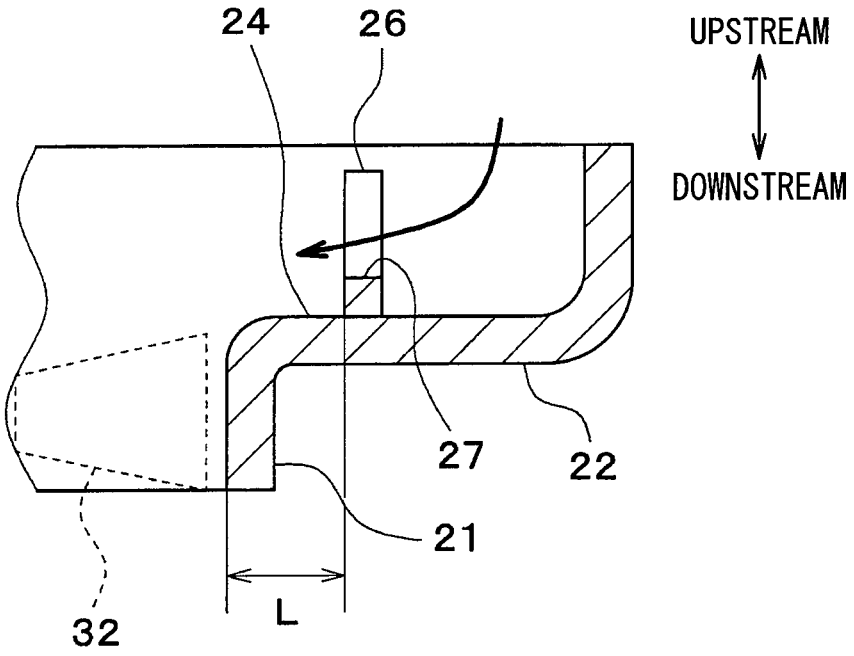
FIG. 3 is a sectional view taken along a line III-III shown in FIG. 2.

As shown in FIGS. 2 and 3, a protruding part 26 that protrudes toward an upstream side in the airflow direction is provided in the connection part 22 along a boundary between the air-introduction part 24 excluding the protruding part 25 and a portion other than the air-introduction part 24. In other words, the connection part 22 has the protruding part 26 that is provided along the boundary between an outer periphery of the air-introduction part 24 excluding the protruding part 25 and a peripheral portion of the connection part 22. According to the present embodiment, the protruding part 26 is provided in each portion that corresponds to each of four corners of the connection part 22.

More specifically, the protruding part 26 is provided continuously connected to an outer end surface 250 of the protruding part 25 located on an outer side in the radial direction of the axial fan 3. That is, the outer end surface 250 and the protruding part 26 are arranged alternately along a circle that is concentrically with the rotational axis of the axial fan 3. Therefore, according to the present embodiment, the air-introduction part 24 is formed between a portion, in which the ring part 21 and the connection part 22 connect to each other, and the outer end surface 250 or the protruding part 26.

Figure 4:
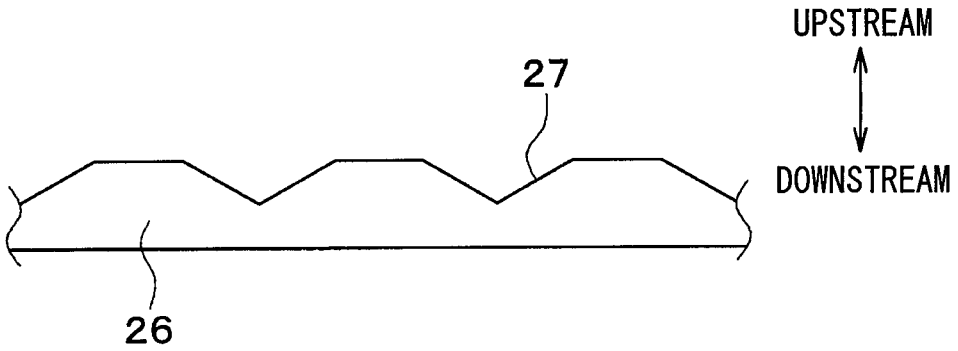
FIG. 4 is a view that is viewed as shown by an arrow IV in FIG. 2.

As shown in FIG. 4, the protruding part 26 is provided with a notch 27 that is cut toward a downstream side in the airflow direction. The notch 27 is one of notches that are arranged at regular intervals (i.e., a pitch of 10° in the present embodiment).

Figure 5:
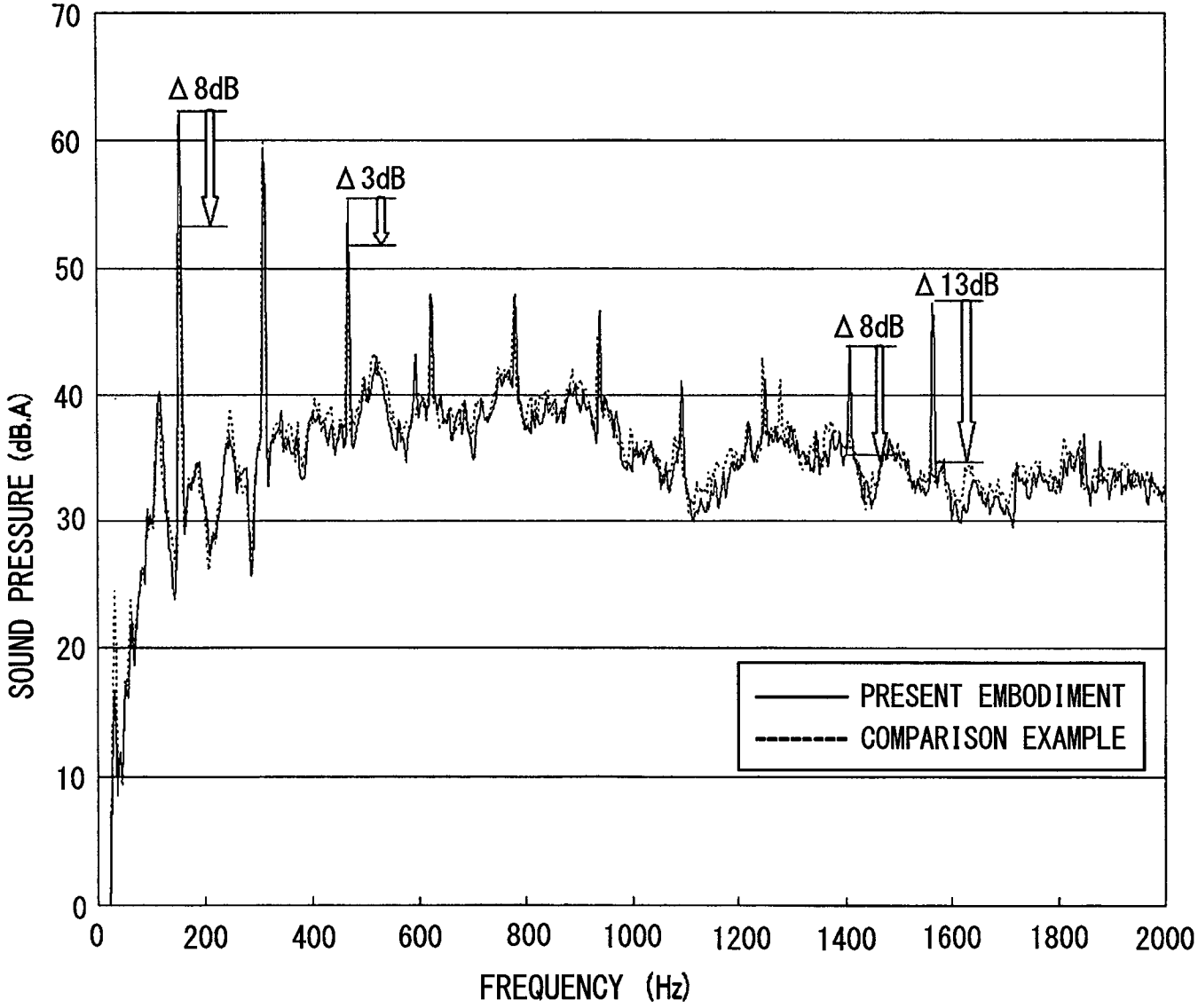
FIG. 5 is a characteristic diagram showing a relation between a frequency and a sound pressure.

FIG. 5 is a characteristic diagram showing a relation between a frequency and a sound pressure according to the air-blowing device. In FIG. 5, a solid line shows a noise of the air-blowing device according to the present embodiment, and a dash line shows a noise of an air-blowing device according to a comparison example. In the air-blowing device of the comparison example, the protruding part 26 is omitted with respect to the air-blowing device of the present embodiment. As obvious from FIG. 5, according to the air-blowing device of the present embodiment, a rotational order sound-component can be reduced as compared to the air-blowing device of the comparison example.

As described above, according to the present embodiment, the air-introduction part 24 that is formed concentrically to be centered at the rotational axis of the axial fan 3 is provided in the portion in which the ring part 21 and the connection part 22 connect to each other. The length of the air-introduction part 24 in the radial direction of the axial fan 3 is fixed along all circumferences. Accordingly, since the length of air-introduction part to guide air to the axial fan 3 is fixed along all circumferences, a pressure variation on a surface of the blades 32 of the axial fan 3 can be suppressed. Therefore, the rotational order sound-component can be reduced, and noise can be reduced certainly.

In the present disclosure, a condition "the length of the air-introduction part 24 in the radial direction of the axial fan 3 is fixed along all circumferences" does not mean only a condition that the length of the air-introduction part 24 in the radial direction of the axial fan 3 is completely fixed along all circumferences, and may mean a condition that the length is generally fixed but slightly un-uniform by a manufacturing error or an assembly error.

According to the present embodiment, each side of the periphery of the radiator 1 is arranged to overlap with the outermost peripheral portion of the axial fan 3 when viewed in the airflow direction. Accordingly, the airflow caused by the axial fan 3 is easily supplied to an entirety of a surface of the radiator 1, and a cooling performance of the radiator 1 can be improved. Thus, the noise can be reduced certainly while securing the cooling performance of the radiator 1.

In this occasion, in a portion in which the periphery of the radiator 1 and the outermost peripheral portion of the axial fan 3 are arranged to overlap with each other when viewed in the airflow direction, a length of the connection part 22 in the radial direction becomes extremely short, thereby it may be difficult to provide the air-introduction part 24.

In contrast, according to the present embodiment, the connection part 22 has the protruding part 25 that protrudes outwardly from the periphery 220 of the connection part 22 in the radial direction of the axial fan 3 when viewed in the airflow direction, and the protruding part 25 is configured as a part of the air-introduction part 24. Accordingly, the cooling performance of the radiator 1 can be improved while reducing the noise.

Furthermore, according to the present embodiment, the protruding part 26 is provided with the notch 27 that is cut toward the downstream side in the airflow direction. Accordingly, air is easily introduced to the axial fan 3 from the four corners of the connection part 22, and a decrease of air amount in the four corners can be restricted. Thus, the noise can be reduced certainly.

Second Embodiment

Figure 6:
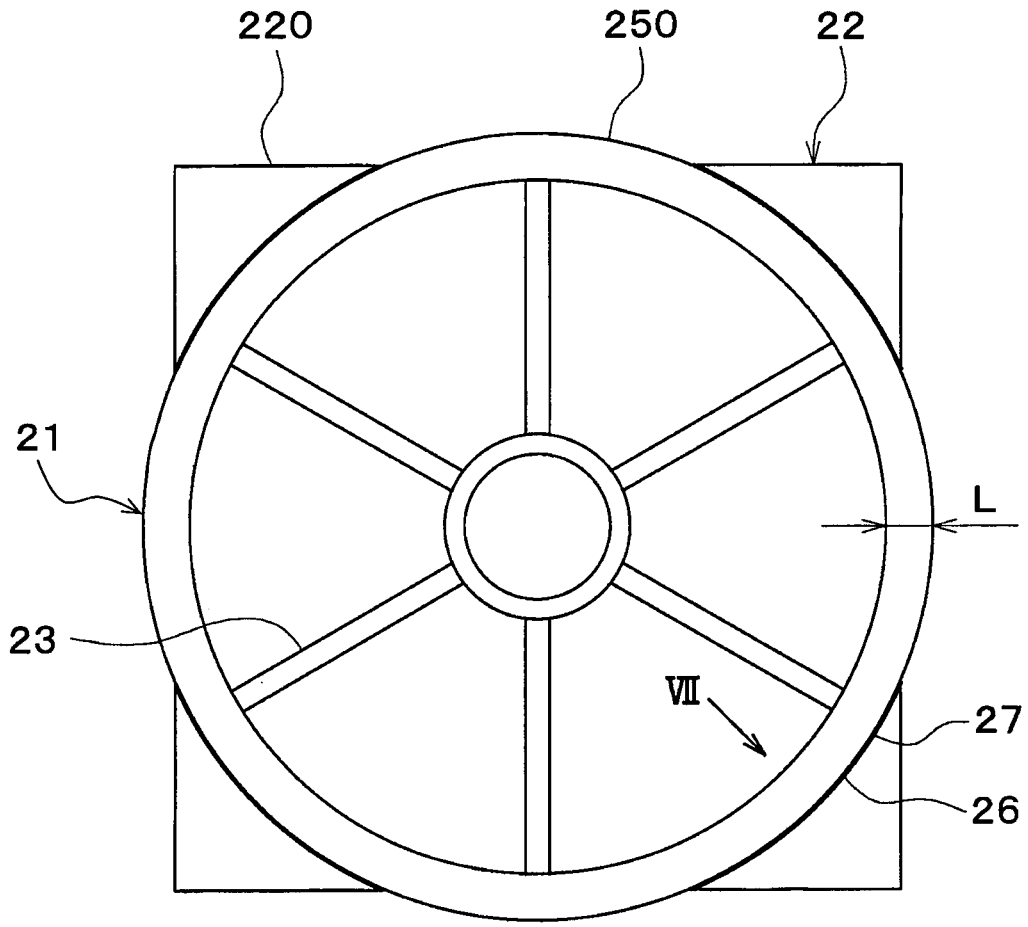
FIG. 6 is a plane view illustrating a shroud according to a second embodiment.
Figure 7:
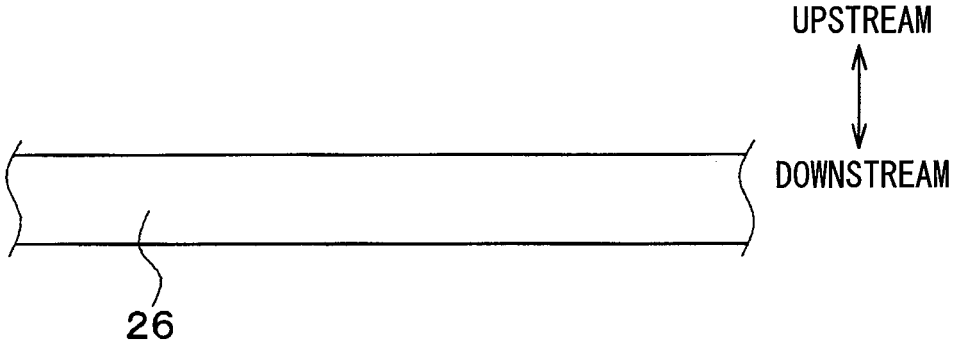
FIG. 7 is a view that is viewed as shown by an arrow VII in FIG. 6.

A second embodiment of the present disclosure will be described hereafter referring to FIGS. 6 and 7. As shown in FIGS. 6 and 7, in the second embodiment, the protruding part 26 is provided with no notch 27. That is, a length of the protruding part 26 in the airflow direction is fixed. According to the present embodiment, since the length of air-introduction part to guide air to the axial fan 3 is fixed along all circumferences, the same effects as the above-described first embodiment can be acquired.

Other Modification

It should be understood that the present disclosure is not limited to the above-described embodiments and intended to cover various modification within a scope of the present disclosure as described hereafter.

(1) In the above-described first embodiment, an example in which the protruding part 26 has the notches 27 that are cut toward the downstream side in the airflow direction and are arranged at regular intervals is described. However, for example, the protruding part 28 may have a single notch 27 or have the notches 27 as required.

(2) In the above-described second embodiment, an example in which the radiator 1 and the connection part 22 are formed in generally the square shape in the plane view, and in which the each side of the periphery of the radiator 1 is arranged to overlap with the outermost peripheral portion of the axial fan 3 when viewed in the airflow direction is described. However, the radiator 1, the shroud 2, and the axial fan 3 are not limited to have such structures.

That is, for example, the radiator 1 and the connection part 22 may be formed in a rectangular shape, and two longitudinal sides of the periphery of the radiator 1 may be arranged to overlap with the outermost peripheral portion of the axial fan 3 when viewed in the airflow direction. Alternatively, one longitudinal side of the periphery of the radiator 1 may be arranged to overlap with the outermost peripheral portion of the axial fan 3 when viewed in the airflow direction.

(3) In the above-described embodiments, an example in which the radiator 1 is employed as the heat exchanger that is located on the upstream side of the axial fan 3 in the airflow direction. However, a radiator that cools refrigerant by causing a heat exchange between the refrigerant circulating in a refrigeration cycle and air may be used as the heat exchanger. Alternatively, the radiator may be arranged on an upstream side of the radiator 1 in the airflow direction.

What is claimed is:

1. An air-blowing device comprising:

a blower fan that is an axial fan located on a downstream side of a heat exchanger in an airflow direction and supplies air to the heat exchanger; and a shroud that supports the blower fan and forms an air passage extending from the heat exchanger to the blower fan, wherein the heat exchanger has a rectangular outline when viewed in the airflow direction, at least one side of a periphery of the heat exchanger is arranged to overlap with an outermost peripheral portion of the blower fan that is outermost in a radial direction of the blower fan when viewed in the airflow direction, the shroud is integrally formed of:

a ring part that is formed in an annular shape and covers an outer periphery of the blower fan, the blower fan being disposed rotatably on an inner side of the annular shape;

a connection part that connects a space on the downstream side of the heat exchanger to the ring part; and an air-introduction part that connects the ring part and the connection part to each other, the air-introduction part facing the heat exchanger and being formed concentrically to be centered at a rotational axis of the blower fan, a part of the air-introduction part, as a protrusion, protrudes outwardly from a periphery of the connection part in the radial direction of the blower fan when viewed in the airflow direction, the protrusion includes an outer end surface having an arc shape in a cross section perpendicular to the rotational axis of the blower fan, the connection part includes a protruding part extending on and along a virtual circle defined by the outer end surface of the protrusion and protruding toward an upstream side along the airflow direction, the protrusion includes a first protrusion and a second protrusion, the first protrusion protrudes outwardly from one periphery of the connection part in the radial direction, the second protrusion protrudes outwardly from another periphery of the connection part in the radial direction, and the protruding part connects the first protrusion with the second protrusion in a circumferential direction without a step.

2. The air-blowing device according to claim 1, wherein the protruding part is provided with a notch that is cut toward a downstream side in the airflow direction.

3. The air-blowing device according to claim 2, wherein the notch is one of a plurality of notches that are arranged equidistantly spaced apart from each other at regular intervals at a corner portion of the connection part.

4. The air-blowing device according to claim 1, wherein the shroud is a single component integrally formed of the ring part, the connection part and the air-introduction part.

5. The air-blowing device according to claim 1, wherein the rectangularly outlined heat exchanger has four corners and the protruding part is located only at each of the four corners.

6. An air-blowing device comprising:

a blower fan that is an axial fan located on a downstream side of a heat exchanger in an airflow direction and supplies air to the heat exchanger; and a shroud that supports the blower fan and forms an air passage extending from the heat exchanger to the blower fan, wherein the heat exchanger has a rectangular outline when viewed in the airflow direction, at least one side of a periphery of the heat exchanger is arranged to overlap with an outermost peripheral portion of the blower fan that is outermost in a radial direction of the blower fan when viewed in the airflow direction, the shroud is integrally formed of:

a ring part that is formed in an annular shape and covers an outer periphery of the blower fan, the blower fan being disposed rotatably on an inner side of the annular shape;

a connection part that connects a space on the downstream side of the heat exchanger to the ring part; and an air-introduction part that connects the ring part and the connection part to each other, the air-introduction part facing the heat exchanger and being formed concentrically to be centered at a rotational axis of the blower fan, a part of the air-introduction part, as a protrusion, protrudes outwardly from a periphery of the connection part in the radial direction of the blower fan when viewed in the airflow direction, the protrusion includes an outer end surface having an arc shape in a cross section perpendicular to the rotational axis of the blower fan, the connection part includes a protruding part extending on and along a virtual circle defined by the outer end surface of the protrusion and protruding toward an upstream side along the airflow direction, and the protrusion and the protruding part extend continuously on and along an entire circumference of the virtual circle.

7. The air-blowing device according to claim 6, wherein the protruding part is provided with a notch that is cut toward a downstream side in the airflow direction.

8. The air-blowing device according to claim 7, wherein the notch is one of a plurality of notches that are arranged equidistantly spaced apart from each other at regular intervals at a corner portion of the connection part.

9. The air-blowing device according to claim 6, wherein the shroud is a single component integrally formed of the ring part, the connection part and the air-introduction part.

10. The air-blowing device according to claim 6, wherein the rectangularly outlined heat exchanger has four corners and the protruding part is located only at each of the four corners.

* * * * *